United States Patent [19]

Kirsinas, Jr.

[11] 4,242,792

[45] Jan. 6, 1981

[54] PORTABLE TOOL FOR MASS TERMINATION CONNECTOR

[75] Inventor: Peter Kirsinas, Jr., Country Club Hills, Ill.

[73] Assignee: Panduit Corp., Tinley Park, Ill.

[21] Appl. No.: 45,578

[22] Filed: Jun. 4, 1979

[51] Int. Cl.[3] ..... H01R 43/00

[52] U.S. Cl. ..... 29/857; 29/566.4; 29/750

[58] Field of Search ..... 29/566.4, 750, 751, 29/752, 33 M, 566.3, 566.1, 749, 628, 629

[56] References Cited

U.S. PATENT DOCUMENTS

| | | | |
|---|---|---|---|
| 3,758,935 | 9/1973 | Long et al. | 29/566.4 |
| 3,816,897 | 6/1974 | Long | 29/56.6 |
| 3,845,535 | 11/1974 | Over | 29/749 X |
| 3,859,724 | 1/1975 | Folkenroth | 29/566.4 X |
| 3,864,802 | 2/1975 | Tucci | 29/566.3 |
| 4,080,717 | 3/1978 | Bunnell | 29/566.4 X |
| 4,174,560 | 11/1979 | Senior et al. | 29/566.1 |

*Primary Examiner*—William R. Briggs

*Attorney, Agent, or Firm*—Charles R. Wentzel; Richard B. Wakely

[57] ABSTRACT

A portable tool and method for simultaneously terminating a plurality of conductors in a connector positioned in a connector support which is mounted on a wiring board. The connector includes a housing defining a series of spaced wire-receiving cavities and a metallic terminal element having a wire-receiving portion disposed in each cavity with the conductors positioned in alignment with the cavities. The tool includes means for detachably mounting the tool on the connector support, a ram which reciprocates relative to the connector, an insertion assembly carried by the ram, movable cutter means carried by the ram adjacent the insertion assembly, and fixed cutter means underlying the conductors when the tool is mounted on the support. The insertion assembly includes a plurality of wire insertion fingers for moving the conductors into the cavities. The movable and fixed cutter means cooperate to sever excess portions of the conductors substantially flush with a wall of the housing as the ram extends causing the wire-insertion fingers to move the conductors into cavities where they are terminated in the wire-receiving portions of the terminal elements. Thus, a single tool can be used to terminate conductors in a plurality of connectors held at spaced locations on the wiring board.

16 Claims, 16 Drawing Figures

PORTABLE TOOL FOR MASS TERMINATION CONNECTOR

BACKGROUND OF THE INVENTION

The present invention relates to tools for terminating conductors and more particularly to a portable tool for simultaneously terminating a plurality of conductors in a mass termination connector.

Mass termination connectors, which function to remove insulation from and electrically terminate a plurality of conductors in response to a single stroke of an insertion tool, are coming into increasing commercial prominence because of their great savings of tedious manual operations compared with the previous wiring method of stripping the insulation from individual conductors, placing a terminal on each conductor and crimping the respective terminals on the respective conductors. A mass termination connector, an example of which is fully disclosed in commonly assigned U.S. Pat. No. 4,191,442, includes a housing having a front wall and a back wall joined by a plurality of spaced barrier walls defining an array of cavities for holding individual metallic terminal elements. Aligned openings in the front and back walls extend from the wire-receiving face of the housing to provide entrances to the various cavities so that conductors positioned over the cavities can be moved laterally of their axes to terminate them in the terminal elements.

Various types of tools have been proposed for inserting the conductors into the mass termination connectors. The simplest type is of the hand variety having an enlarged head, no moving parts and which can terminate only one wire at a time. A pneumatic gun-type tool has been suggested which holds and indexes the connector to terminate one wire at a time. Such tools are not well suited for use with conductors positioned on a wiring layout board because of their modest insertion rates or because the conductors must be lifted from the board and positioned in the tool.

A portable tool has also been suggested for use with wiring board mounting conductors, the tool functioning to sever the excess portions of the conductors extending from the connector as it terminates all the conductors simultaneously. This tool requires the use of a plurality of connector supports or jigs positioned at the desired ends of the completed wiring harness for holding the connectors and separate wiring jigs for positioning the various conductors in alignment with the cavities in the connector housings. Each connector support is required to carry its own fixed cutter blade for cooperation with a movable cutter blade on the tool to sever the excess portions of the conductors. Care must be exercised in mounting the tool to insure the movable and fixed cutter blades are precisely aligned. Reference may be made to U.S. Pat. Nos. 3,845,535 and 3,859,724.

SUMMARY OF THE INVENTION

Among the several objects of the present invention may be noted the provision of an improved portable tool for simultaneously terminating conductors in a mass termination connector and concurrently severing the excess portion of each conductor; the provision of such a tool which avoids the requirement that each connector support carries a separate fixed cutter blade; the provision of such a tool which maintains alignment of the fixed cutter blade and the movable cutter means; the provision of such a tool which is quickly and easily mounted on and dismounted from the respective connector supports; and the provision of such a tool which is light in weight, has long service life and is simple and economical to manufacture. Other objects and features of the present invention will be in part apparent and in part pointed out hereinafter in the specification and in the claims.

Briefly, the portable tool of the present invention includes means for detachably mounting the tool on a connector support, a ram which reciprocates relative to the connector held in the support, and an insertion assembly carried by the ram and having a plurality of wire insertion fingers for moving the conductors into the housing cavities. The tool further includes movable cutter means carried by the ram adjacent the insertion assembly and fixed cutter means underlying the conductors when the tool is mounted on the support. The movable and fixed cutter means cooperate to sever excess portions of the conductors substantially flush with a wall of the housing as the ram extends causing the wire insertion fingers to move the conductors into the cavities where they are terminated in the terminal elements.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
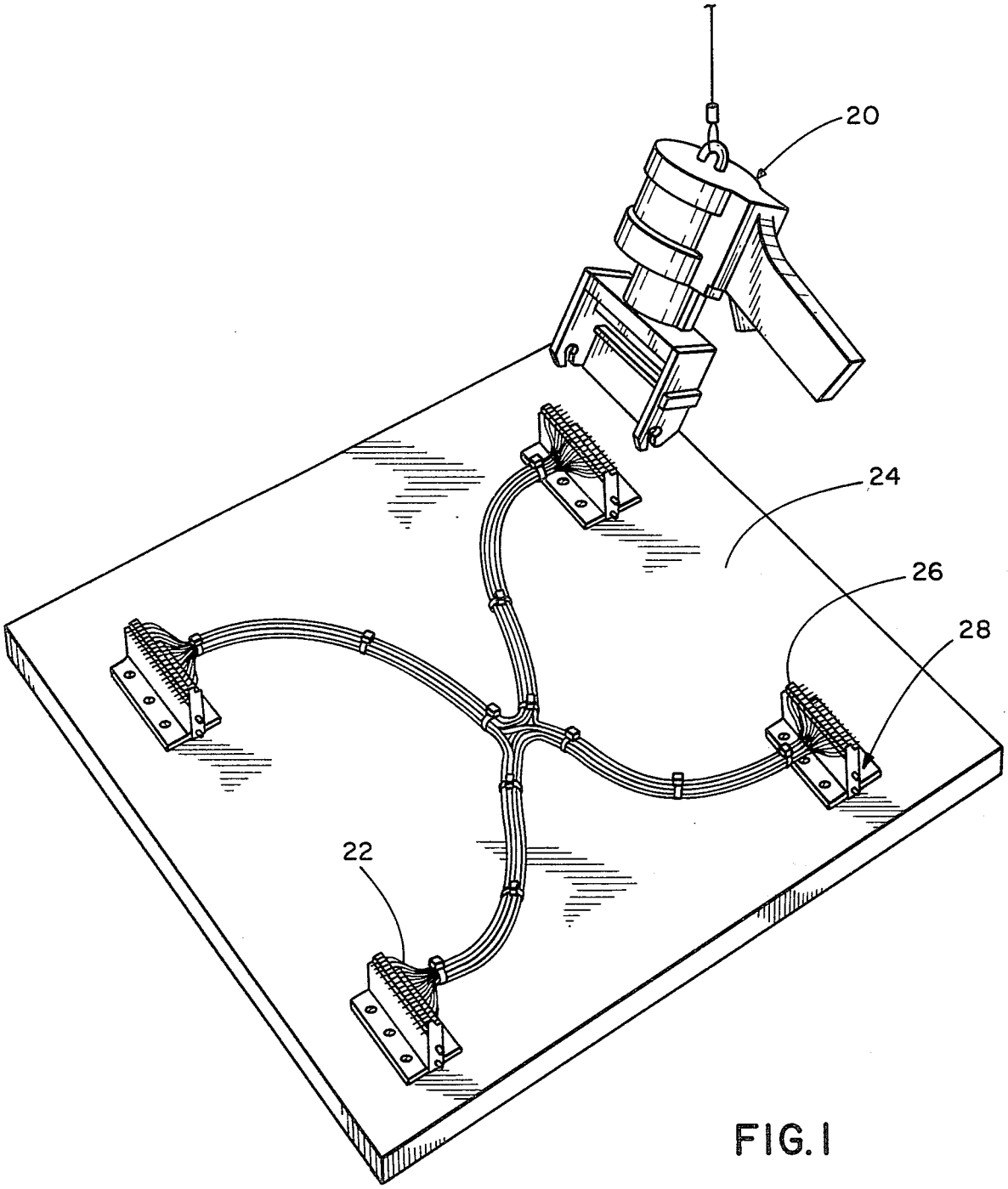
FIG. 1 is a perspective view of a wiring board upon which are disposed a plurality of connector supports holding connectors in position for termination of wires at the desired ends of a wiring harness, and a portable tool for sequential mounting on each of the connector supports to terminate respective wires in respective terminal elements of the connectors.
Figure 2:
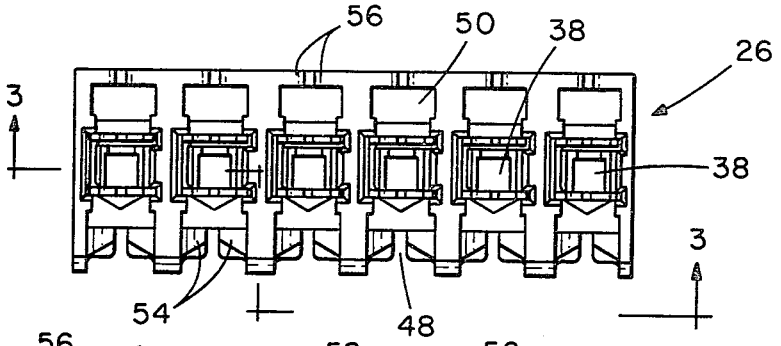
FIGS. 2, 3 and 4 are, respectively, plan, front and side views of the connector of FIG. 1.
Figure 3:
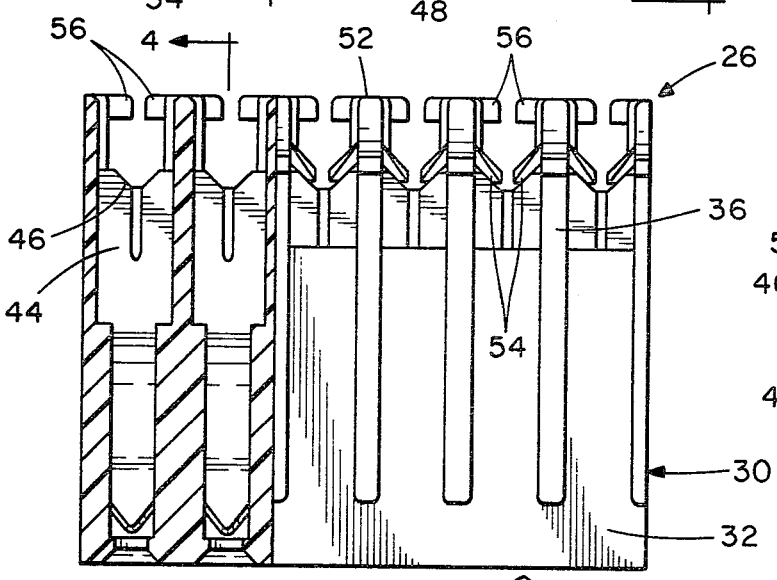
Figure 4:
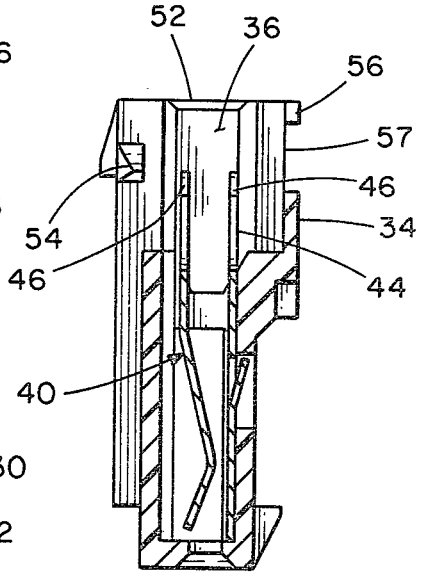
Figure 5:
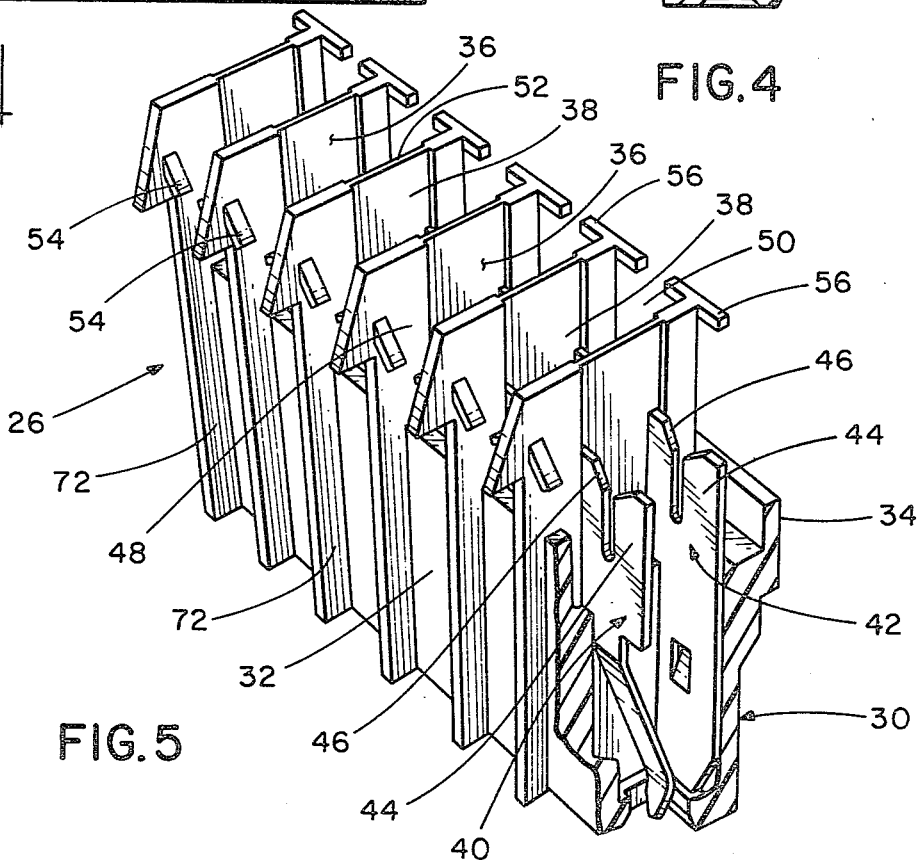
FIG. 5 is a perspective view of the connector with certain components thereof removed to expose one of the terminal elements held by the connector housing.

Referring now to the drawings, a portable tool for terminating conductors 22 disposed on a panel board or wiring board 24 is generally indicated in FIG. 1 by reference numeral 20. Tool 20 is used to terminate conductors mechanically held by connectors 26 which are in turn held by connector supports 28 mounted on the wiring board at positions analogous to the desired ends or breakout points of a wiring bundle to be formed by conductors 22.

A mass termination connector similar to connector 26, best shown in FIGS. 2–5, is fully shown and described in commonly-assigned U.S. Pat. No. 4,191,442. The connector comprises a housing 30 including a front wall 32, a rear wall 34, and a plurality of regularly spaced barrier walls 36 which together define an array of cavities 38. Positioned in each cavity is a metallic terminal element 40 including a self-stripping wire-receiving portion 42. The wire-receiving portion includes a pair of spaced slotted plates 44 each having an entrance 46 for guiding a wire into the slot. It will be appreciated that a conductor positioned over the entrances and moved laterally of its axial direction into the slots will have its insulation removed by the plate sections defining the slots resulting in electrical termination of the conductor in the terminal element. The front and rear walls each have a series of aligned openings 48 and 50, respectively, extending from a wire-receiving face 52 of the connector housing for permitting access of the various conductors to their corresponding terminal elements.

The front wall 32 includes sets of opposed resilient ears 54 extending into each front wall opening 48 to define a constricted throat to the opening. Similarly rear wall 50 comprises sets of opposed resilient ears 56 extending into each rear wall opening 50 to define a constricted throat to a back wall opening. Respective sets of ears 54 and 56 as well as portions of plates 44 defining entrances 46 cooperate to deflect a conductor 22 out of its as-manufactured axial direction and constitute means for mechanically holding each conductor in alignment with a respective cavity prior to termination of the conductor. Rear wall 34 includes a slot 57, best shown in FIG. 4, underlying ears 56 for receiving a fixed cutter blade of tool 20 as will be discussed more fully hereinafter.

Figure 6:
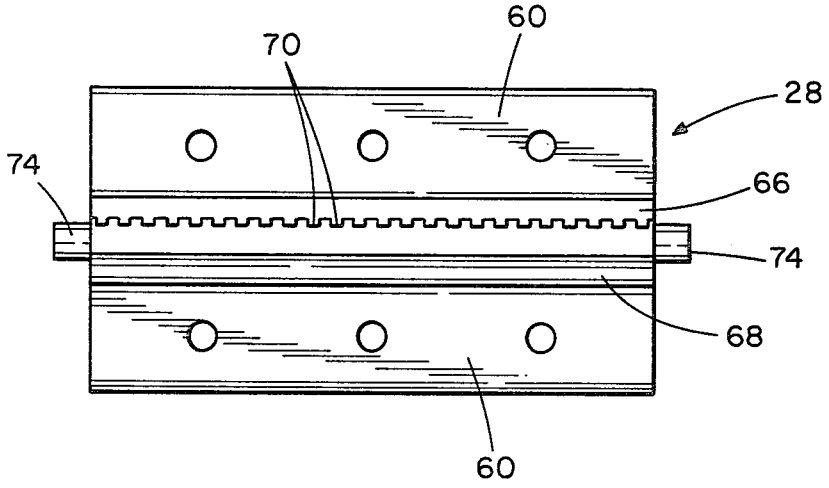
FIGS. 6, 7 and 8 are, respectively plan, front and side views of the connector support of FIG. 1.
Figure 7:
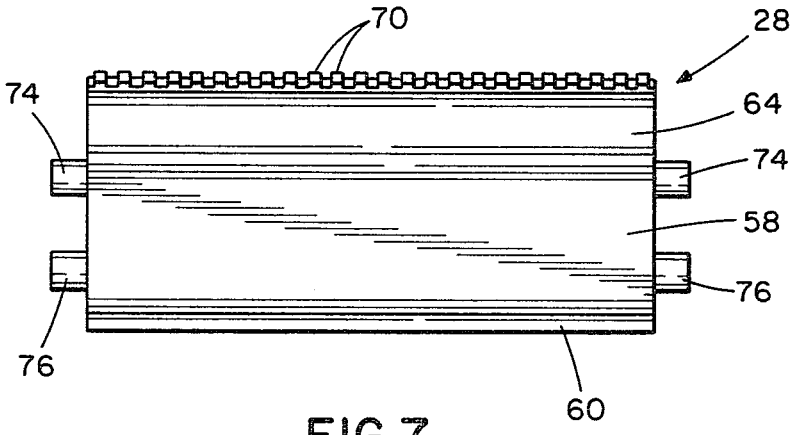
Figure 8:
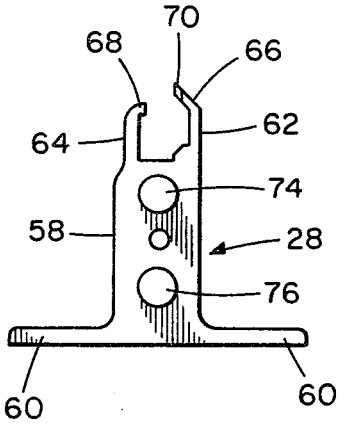
Figure 9:
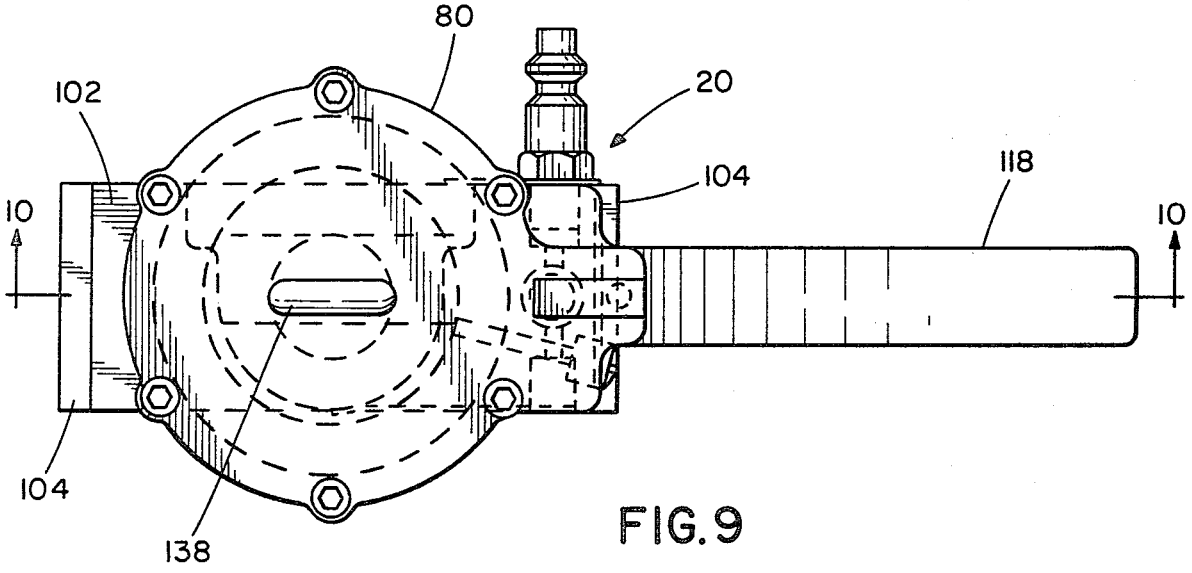
FIG. 9 is a plan view of the portable tool of FIG. 1.

Turning now to FIGS. 6–8, connector support 28 includes a base 58 from each side of which extends a mounting foot 60 having screw-receiving apparatus for fixing the support on wiring board 24. Extending upwardly from base 58 are a pair of spaced resilient walls 62, 64 terminating in respective inwardly turned arms 66, 68 for holding a connector 26 therebetween. Arm 66 includes spaced fingers 70 for reception between spaced ribs 72 extending from connector housing front wall 32 to preclude lateral movement of the connector relative to the support. Each side of base 58 carries a pair of stacked lugs 74, 76 which, in part, constitute means for detachably mounting portable tool 20 on connector support 28.

Portable tool 20, which acts to simultaneously terminate a plurality of conductors 22 mechanically held by connector housing 30 while concurrently severing an excess portion of the conductors extending from the housing, is best described with reference to FIGS. 9–12. Tool 20 includes a frame 78 upon which is mounted a pneumatic cylinder 80 having a pair of coaxial bores 82, 84 separated by a divider 86. Positioned in the bores are a pair of pistons 88, 90 mounted in tandem on a common shaft 92. It should be appreciated that the use of a cylinder having pistons connected in tandem has a much smaller diameter than a cylinder having only a single piston and which provides the same force characteristics. Shaft 92 is joined to an elongate ram 94 which carries an insertion assembly 96 including a plurality of spaced wire-insertion fingers or stuffers 97 which function to move the conductors 22 from their pretermination position wherein they are mechanically held by the connector housing and into their respective cavities where they are terminated in the wire-receiving portions of their corresponding terminal element 40. Attached to the insertion assembly is movable cutter means in the form of a single conductor-severing blade 98 aligned with each wire-insertion finger. The insertion assembly carries a set of spacers 100 on the other side of the wire-insertion fingers 97 relative to blades 98 for engaging the respective conductors 22 at a position between the plate 44 closest housing front wall 32 and the front wall.

Frame 78 includes a cross member 102 and a pair of side plates 104 which constitute, in part, means for detachably mounting tool 20 on connector support 28. Spaced from cross member 102 and joining side plates 104 is a reinforcing block 106 to which is attached a cutter block 108 terminating in a fixed cutter blade 110 which is precisely aligned with each of the movable cutter blades 98 carried by insertion assembly 96.

Figure 13:
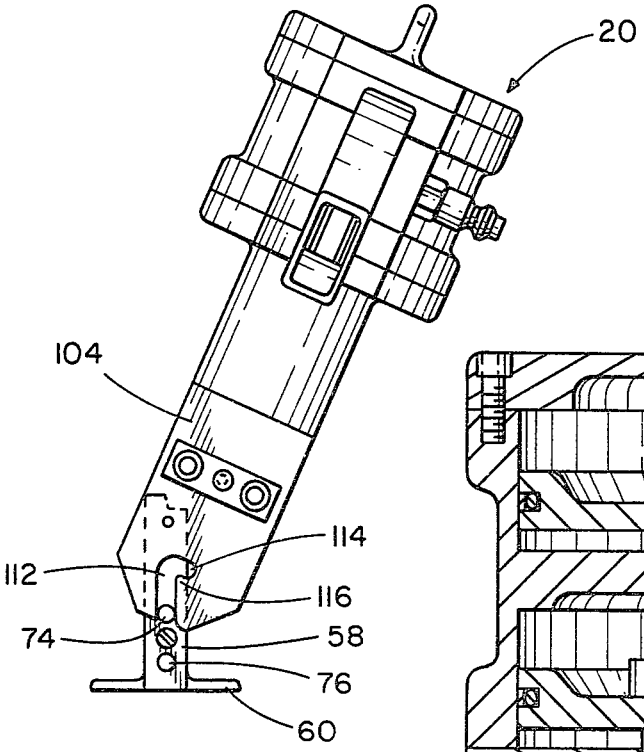
FIG. 13 shows the tool being moved toward a housing support.

Side plates 104 each include an aligned first or guide slot 112 which is inclined and each of which receives the pair of stacked lugs 74, 76 extending from one side of connector support base 58. Referring to FIG. 13, guide slots 112 constitute guide means for guiding tool 20, which is disposed tilted so that the longitudinal axis of ram 94 is inclined relative to the wire insertion direction of a connector 26 held by connector support 28, onto the connector support when portable tool 20 is moved downwardly toward the support substantially in the wire-insertion direction of the connector. The wire-insertion direction is preferably substantially perpendicular to the surface of wiring board 24.

Adjoining each guide slot 112 is a second or holding slot 114 for receiving one of the upper lugs 74. Slots 114, which in part constitute holding means for holding tool 20 mounted on connector support 28 with the axis of ram 94 generally parallel to the wire-receiving direction of the connector, extend generally perpendicularly to the axis of ram 94. Each side plate 104 includes a ledge 116 which partially define a holding slot 114 and which underlies and reacts against an upper lug 74 as ram 94 extends effecting termination of conductor 22 in connector 26.

Figure 11:
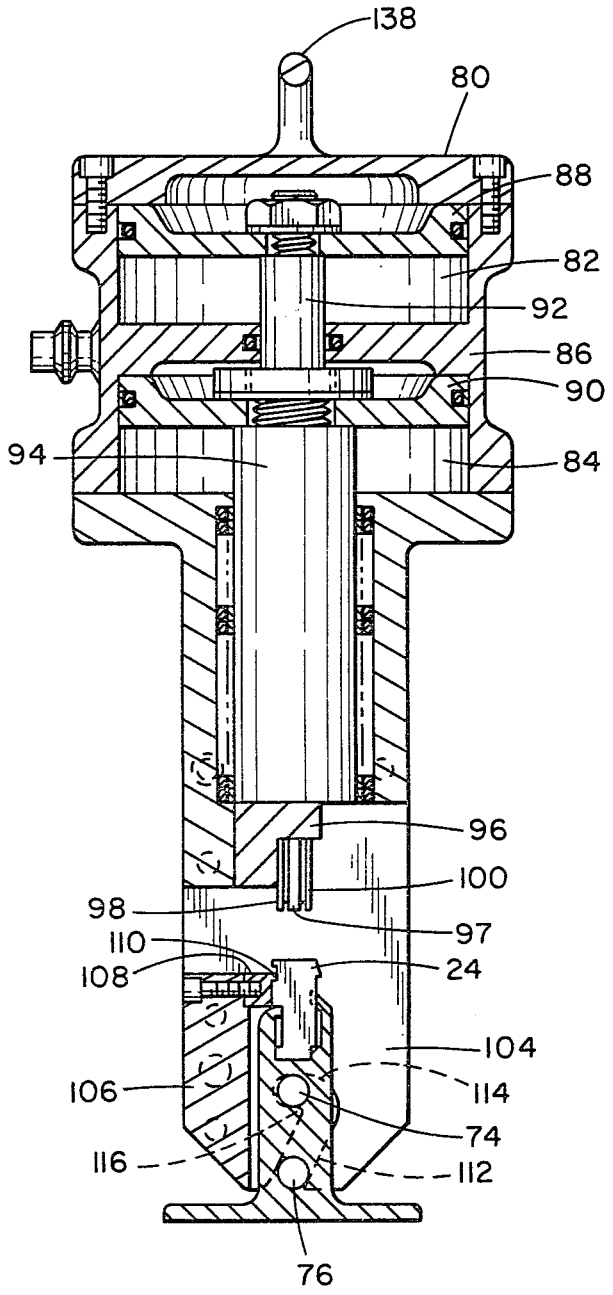
FIG. 11 is a sectional view of the tool taken generally along line 11—11 of FIG. 10.
Figure 14:
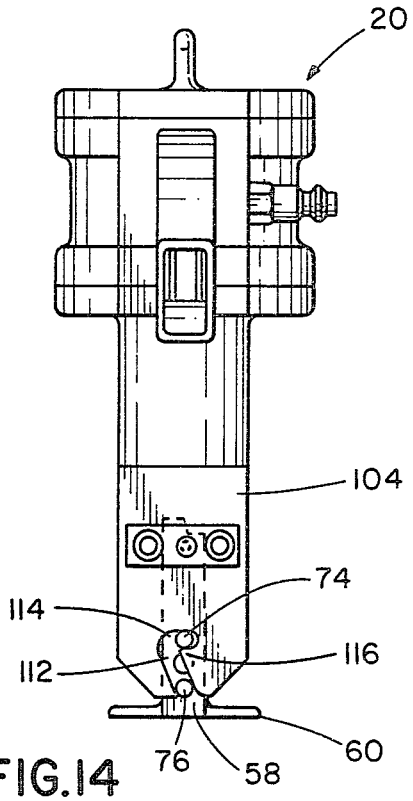
FIG. 14 shows the tool fully mounted on the housing support.

Referring to FIGS. 13 and 14, portable tool 20 is movable on the connector support between a guided position wherein the longitudinal axis of ram 94 is inclined relative to the wire insertion direction of connector 28 and the fixed cutter blade 110 is remote from connector housing 30, and a termination position, FIG. 14, wherein the ram axis is parallel to the wire-insertion direction and the fixed cutter blade 110 is disposed adjacent housing rear wall 34 as shown in FIG. 11. More specifically, in mounting tool 20 on support 28 the tool is positioned over the support and inclined so that guide slots 112 extend generally normal to the plane of wiring board 24 and are aligned with the pairs of stacked lugs 74, 76. It should be noted that as the tool is removed downwardly, the fixed cutter blade 110 is spaced significantly from housing rear wall 34. Thus, after the excess portions of conductors 22 extending from rear wall 34 are coarsely trimmed, the tool can be guided on the connector support without interference between the fixed cutter blade 110 and the remaining portions of conductors extending from the connector. Movement of the tool from its guided position to its termination position is effected by rotating the tool, generally about lower lugs 76, until paper lugs 74 are received by holding slots 114 and fully overlie load bearing ledges 116. During this movement of the tool, fixed cutter blade 110 follows an arcuate, upward path and is received by rear wall slot 57 to underlie rear wall ears 56.

Figure 10:
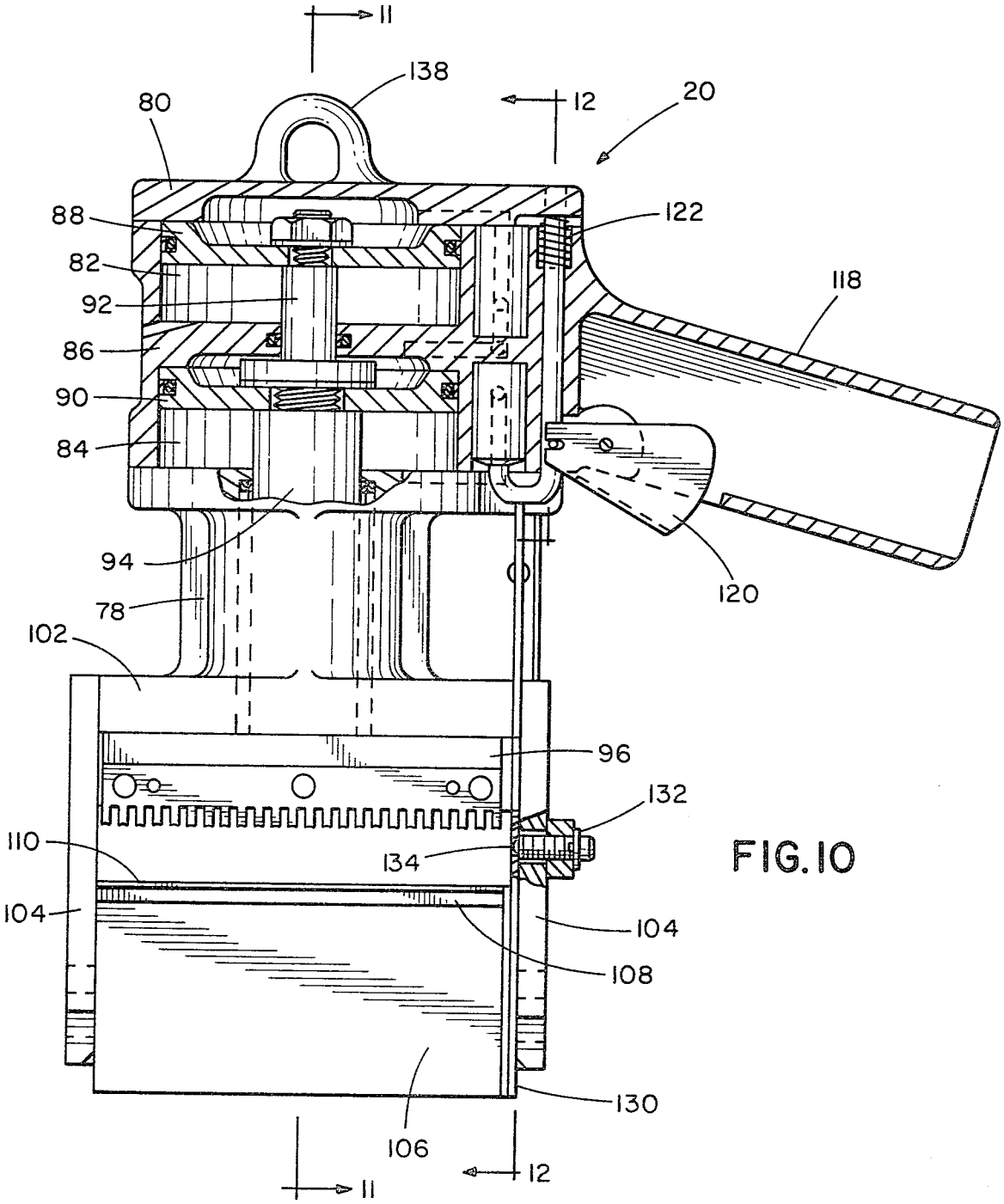
FIG. 10 is a sectional view of the tool taken generally along line 10—10 of FIG. 9.

Extending from cylinder 80 is a hand grip 118, best shown in FIG. 10, housing a pivotally mounted trigger 120 for controlling a four-way valve connected to supply and exhaust pressurized air from the bores 82, 84 of cylinder 80. In the interest of brevity, the valve, air supply and air supply connections and hardware are not fully shown as these are well known by those skilled in the art. Suffice it to say that trigger 120 is biased by a spring 122 to a rest position which causes the valve to supply air to the portions of bores 82 and 84 below respective pistons 88 and 90 and exhaust the upper positions of the bores causing the ram 94 to move to or remain in its retracted position. Actuation of trigger 120 against the influence of spring 122 reverses the valve so that the portions of the bores above the pistons are pressurized and the lower bore portions exhausted effecting extension of the ram to terminate conductors 22 in connector 26.

Figure 12:
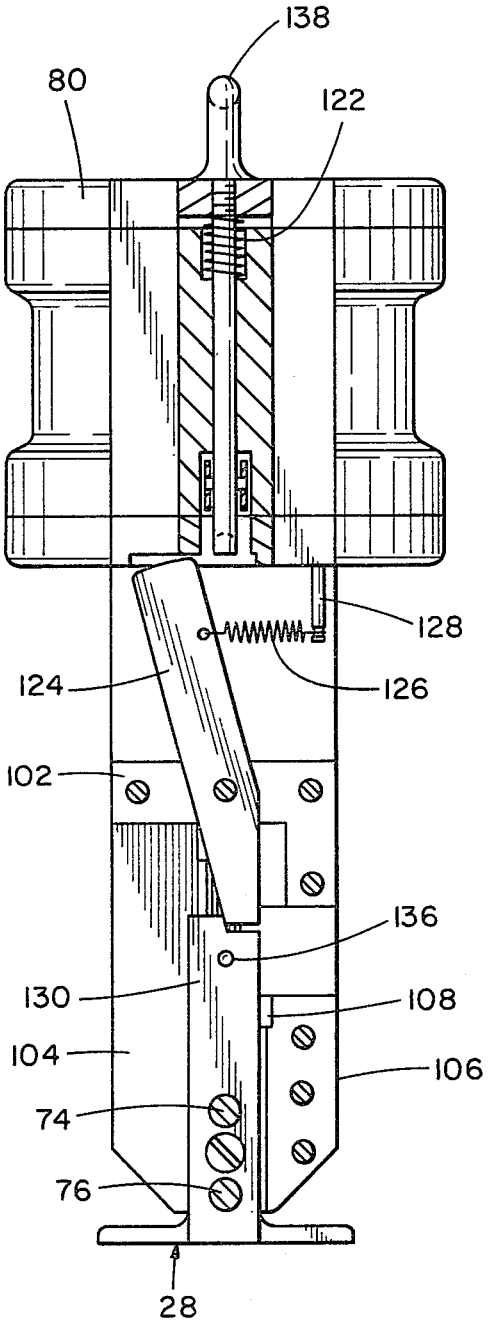
FIG. 12 is a sectional view taken generally along line 12—12 of FIG. 10 depicting a safety interlock system which prevents operation of the tool when it is not mounted on a connector housing support.

In order to prevent operation of the ram when the tool is dismounted from the connector support, a safety interlock system, best shown in FIG. 12, is provided. The system includes a locking bar 124 pivotally carried by cross member 102 and biased by a spring 126 connected to a standard 128 to a locking position in which it underlies trigger 120 to prevent its actuation. Connector support 28 carries an abutment plate 130 which engages the lower end of the locking bar as the tool is moved from its guided position to its termination position to deflect the bar resulting in release of trigger 120. Of course, when the tool is dismounted from the support, the locking bar moves to hold the trigger in its rest position.

The holding means for holding the tool 20 in its termination position also includes a detent assembly 132, best shown in FIG. 10, carried by the side plate 104 disposed adjacent abutment plate 130. Assembly 132 includes a spring-biased detent pin 134 which is received in a depression 136 in plate 130, best shown in FIG. 12, when the tool is moved to its termination position. The detent assembly 132 thus functions to hold the tool in its termination position and to provide some resistance when the tool is moved toward its guided position from which it is dismounted from the connector support.

The top of cylinder 80 has a loop 138 for connection to a counter-balance system (not shown) to reduce the effective tool weight to mitigate against operator fatigue due to repeated use of the tool.

Operation of the portable tool of the present invention is as follows: After the connector supports 28 are positioned on wiring board 24 analogous to the desired ends of the wiring harness to be formed, a connector 26 is loaded into each connector support. Conductors 22 are run between locations in the connectors and the end portions of the conductors are mechanically held by the connector housings prior to their termination by the assembler pushing a conductor laterally of its axis in the wire-receiving direction of the housing into front and rear wall openings 48, 50 until the conductor is trapped beneath front wall ears 54 and rear wall ears 56 and deflected out of its as-manufactured axial direction due to its engagement with entrance 46 of a slotted plate 44 of a terminal element 40. After any particularly long excess portions of conductors 22 extending from a housing rear wall 34 are coarsely trimmed by using a scissors or a side cutters, portable tool 20 is mounted on a support 28 by tilting the tool so that guide slots 112 are aligned with the pairs of stacked lugs 74, 76 and the tool moved downwardly as shown in FIG. 13. The tool is then moved from its guided position to its termination position shown in FIGS. 14 and 15 causing locking bar 124 to be moved releasing trigger 120 and fixed cutter blade to be received by rear wall slot 57. The feature of the tool of the present invention carrying the fixed cutter blade overcomes the shortcoming of prior art tools wherein the connector holding jigs each carried a fixed cutter. It was difficult and time-consuming to properly align the movable cutter, carried by the prior art tool, with each of fixed cutter blades carried by the various connector jigs. Furthermore, the prior art connector jigs were quite expensive since each carried a fixed cutter blade.

Figure 15:
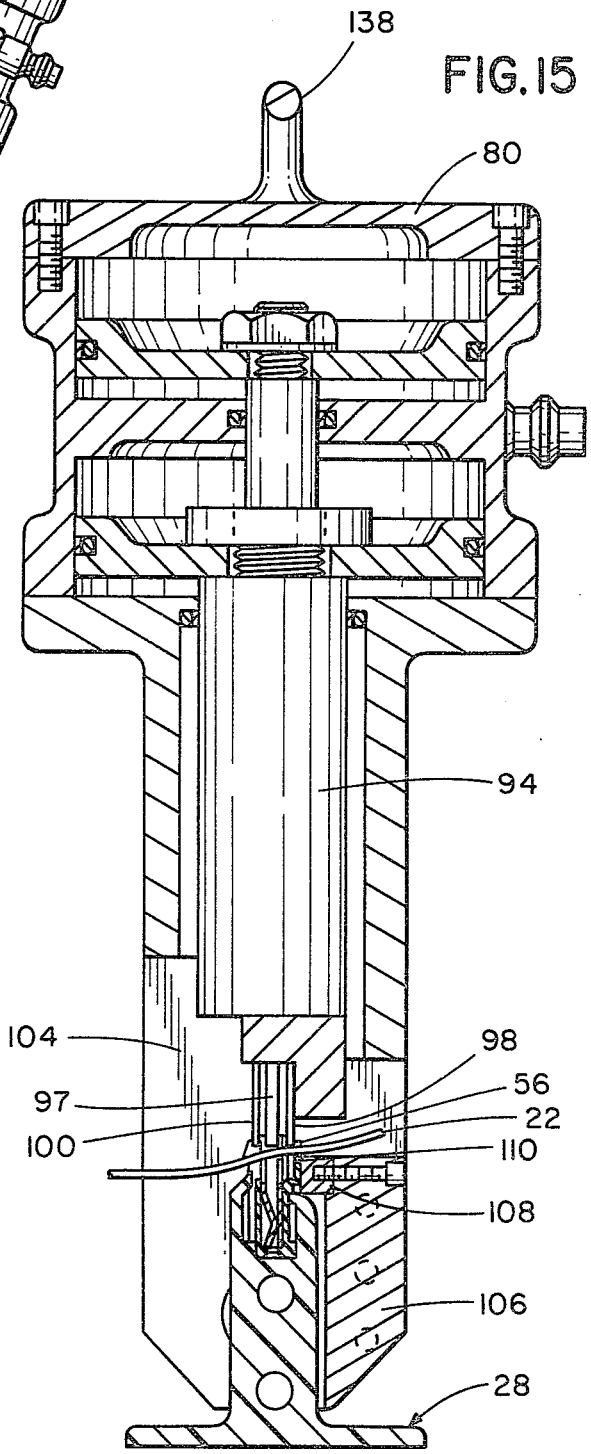
FIG. 15 is a sectional view showing a ram of the tool extending to terminate a conductor and sever the excess portion of the conductor.
Figure 16:
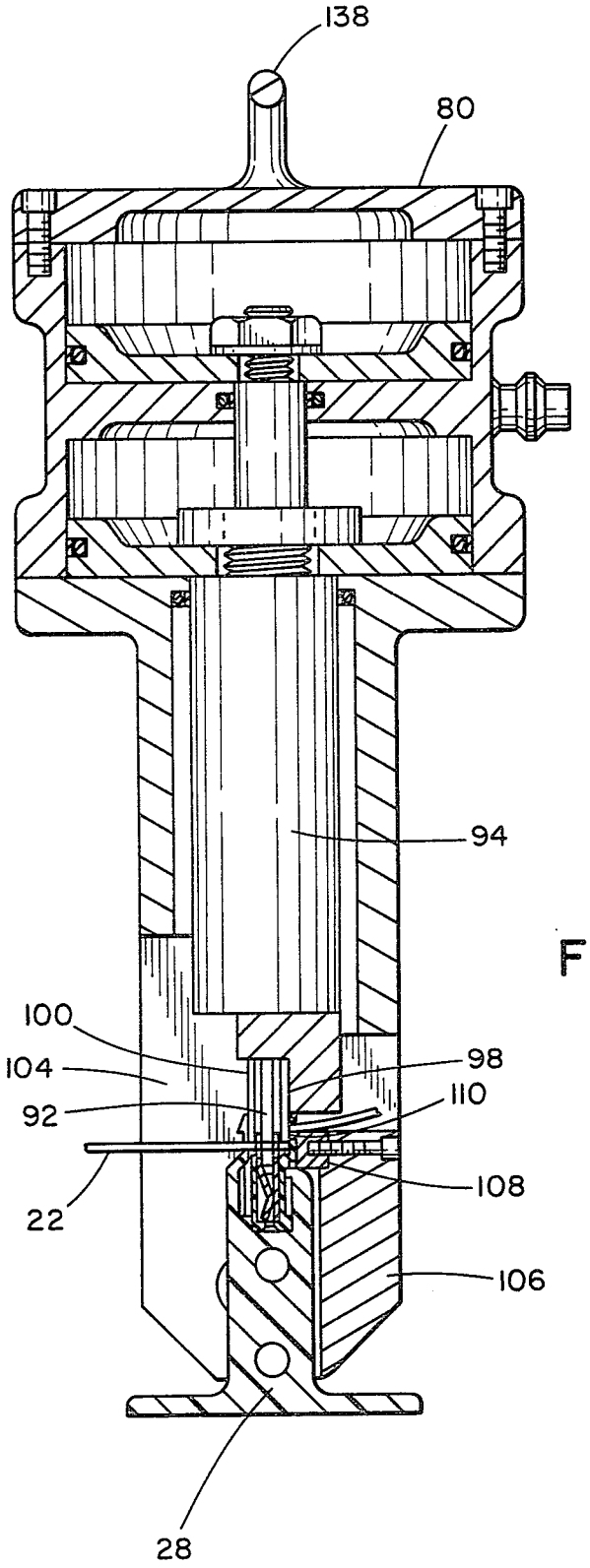
FIG. 16, similar to FIG. 15, illustrates the conductor terminated and the excess portion of the conductor severed.

Referring to FIG. 15, in the termination position of the tool the fixed cutter blade 110 underlies conductors 22 and is aligned with movable cutter blades 98. Actuation of trigger 120 causes ram 94 to extend, as shown in FIG. 16, resulting in wire inserting fingers 97 terminating the conductors in the slotted plates 44 of the respective terminal elements 40 and the fixed and movable cutter blades severing the conductors generally flush with housing rear wall 34. After trigger 120 is released, the ram retracts and the tool can be dismounted by moving it to its guided position and moving it upwardly. The tool is then mounted on each of the remaining connector supports to terminate the conductors in the remaining connectors as above-described. With termination completed, the fabricated wire harness is removed from the wiring board.

As a method of terminating conductors disposed on a wiring board, the present invention includes the steps of: First, connector supports 28 are mounted on the wiring board 24 at locations corresponding to the desired ends of a wire bundle to be formed by the conductors. Second, a connector 26 is positioned in each of the connector supports. Third, various conductors 22 are placed in the holding means of the connectors (beneath the ears 54 and 56 in the front and rear walls of the housing and in engagement with the entrances of slotted plates 44) so that preselected conductors are held in alignment with predetermined housing cavities 38. Finally, portable termination tool 20 is detachably mounted on each connector support and the tool is operated to cause termination of the conductors associated with the connector held by that connector support.

In view of the above, it will be seen that the several objects of the invention are achieved and other advantageous results obtained.

As various changes could be made in the above constructions without departing from the scope of the invention, it is intended that all matter contained in the above description should be interpreted as illustrative and not in a limiting sense.

I claim:

1. A portable tool for simultaneously terminating a plurality of conductors in a connector positioned in a connector support which is mounted on a wiring board or the like, said connector comprising a housing defining a series of spaced wire-receiving cavities and a metallic terminal element having a wire-receiving portion disposed in each cavity, said conductors being positioned in alignment with said cavities, said tool comprising:

means for detachably mounting said tool on said connector support;

a ram which reciprocates relative said connector;

an insertion assembly carried by said ram and including a plurality of wire insertion fingers for moving said conductors into said cavities;

movable cutter means carried by said ram adjacent said dieset; and fixed cutter means underlying said conductors when said tool is mounted on said support, said movable and fixed cutter means cooperating to sever excess portions of said conductors substantially flush with a wall of said housing as said ram extends causing said wire-insertion fingers to move said conductors into said cavities where they are terminated in the wire-receiving portions of said terminal elements whereby a single tool can be used to terminate conductors in a plurality of connectors held at spaced locations on said wiring board.

2. A tool as set forth in claim 1 wherein said ram is elongate and has a longitudinal axis and wherein said connector has a wire-insertion direction, said mounting means comprises guide means for guiding said tool onto said connector support with the longitudinal axis of said ram inclined relative to said wire insertion direction and said tool moved toward said connector support substantially in said wire-insertion direction.

3. A tool as set forth in claim 2 wherein said mounting means further comprises holding means for holding said tool mounted on said connector support with said ram axis parallel to said wire-insertion direction, said tool being movable on said connector support between a guided position wherein said longitudinal axis is inclined relative to said wire-insertion direction and said fixed cutter means is remote from said connector housing and a termination position wherein said ram axis is parallel to said wire-insertion direction and said fixed cutter means is disposed adjacent said housing wall.

4. A tool as set forth in claim 3 wherein said housing support is elongate and has a pair of stacked lugs extending from each end thereof, said detachable mounting means comprising a frame including a pair of side plates for straddling said connector support.

5. A tool as set forth in claim 4 wherein each side plate includes an aligned first slot, inclined with respect to said ram axis, for receiving said stacked lugs, said guide means comprising said slots.

6. A tool as set forth in claim 5 in which each side plate includes a second slot adjoining said first slot for receiving the upper of the pair of stacked lugs, said second slots extending generally perpendicularly to said ram axis and said holding means comprising said second slots.

7. A portable tool as set forth in claim 4 wherein said fixed cutter means comprises a cutter blade mounted on a reinforcing block joining said side plates.

8. A portable tool as set forth in claim 1 further comprising a pneumatic cylinder for reciprocating said ram.

9. A portable tool as set forth in claim 8 wherein said cylinder includes stacked bores and a piston disposed in each bore and mounted on a common shaft which carries said ram.

10. A portable tool as set forth in claim 8 further comprising an interlock for preventing operation of said cylinder when said tool is not mounted on said connector support.

11. A portable tool as set forth in claim 10 further comprising a pivotally mounted trigger for controlling operation of said pneumatic cylinder, said interlock comprising a deflectable lock preventing operation of said trigger when said tool is not mounted.

12. A tool as set forth in claim 6 wherein each side plate includes a ledge which partially defines said second slot, said ledge underlying and reacting against the upper of said pair of stacked lugs as said ram extends to terminate the conductors.

13. A tool as set forth in claim 6 wherein said holding means further comprises a detent carried by one of said side plates.

14. A tool as set forth in claim 2 wherein said wire-insertion direction is substantially perpendicular to the surface of said wiring board.

15. Apparatus for terminating conductors disposed on a wiring board, said apparatus comprising:

a plurality of connector supports mounted on said board at the desired ends of a wiring bundle to be formed by said conductors, a connector held by each of said supports and comprising a housing defining an array of cavities with a self-stripping metallic terminal element disposed in each cavity, said connector comprising means for mechanically holding each conductor in alignment with a respective cavity prior to termination of said conductors, and a portable tool for terminating said conductors in said terminal elements and severing the excess portion of each conductor generally flush with a wall of said housing, said tool and each connector support comprising means for detachably mounting said tool on said connector support, said tool including:

a ram which reciprocates relative to said connector, an insertion assembly carried by said ram including a plurality of wire insertion fingers for moving said conductors into said cavities, movable cutter means carried by said ram adjacent said insertion assembly, and fixed cutter means underlying said conductors when said tool is mounted on said support, said movable and fixed cutter means cooperating to sever excess portions of said conductors substantially flush with a wall of said housing as said conductors are terminated in said terminal elements.

16. A method of terminating conductors disposed on a wiring board comprising the steps of:

mounting connector supports on said board at locations corresponding to the desired ends of a wire bundle to be formed by said conductors;

positioning a connector in each of said connector supports, said connector comprising a housing defining an array of cavities with a self-stripping metallic terminal element disposed in each cavity, said connector including means for mechanically holding a conductor in alignment with each cavity prior to the termination of the conductor in the cavity;

placing various conductors in the holding means of the various connectors so that preselected conductors are held in alignment with predetermined cavities;

sequentially detachably mounting a portable termination tool on each of said connector supports and operating said tool to cause termination of the conductors associated with the connector held by that connector support, said tool carrying movable cutter means and fixed cutter means which cooperate to sever the excess portion of conductors extending from a connector.

* * * * *